US005693949A

United States Patent [19]

Paris

[11] Patent Number: 5,693,949

[45] Date of Patent: Dec. 2, 1997

[54] METHOD AND DEVICE FOR THE CONTINUOUS CHECKING OF THE ACTIVITY OF DUST

[75] Inventor: Jacques Paris, Roquemaure, France

[73] Assignee: Commissariat a l'Energie Atomique, France

[21] Appl. No.: 627,123

[22] Filed: Apr. 3, 1996

[30] Foreign Application Priority Data

Apr. 3, 1995 [FR] France ..... 95 03874

[51] Int. Cl.[6] ..... G21F 9/32

[52] U.S. Cl. ..... 250/435; 250/336.1; 250/394

[58] Field of Search ..... 250/253, 336.1, 250/435, 394, 395; 356/439

[56] References Cited

U.S. PATENT DOCUMENTS

| | | | |
|---|---|---|---|
| 4,092,539 | 5/1978 | Pao et al. | 250/336.1 |
| 4,158,769 | 6/1979 | Smith | 250/435 X |
| 4,782,773 | 11/1988 | Takaoku et al. . | |

FOREIGN PATENT DOCUMENTS

| | | | |
|---|---|---|---|
| 0081698 | 11/1982 | European Pat. Off. . | |
| 0308357 | 8/1988 | European Pat. Off. . | |
| 1-307641 | 12/1989 | Japan | 356/439 |
| 3-293599 | 12/1991 | Japan . | |

OTHER PUBLICATIONS

"Recycling of Metallic Materials from the Dismantling of nuclear Plants" Sappok; Kerntechnik 56 (1991) No. 6; pp. 376–378 no month.

*Primary Examiner*—Edward J. Glick

*Attorney, Agent, or Firm*—Hayes, Soloway, Hennessey, Grossman & Hage, P.C.

[57] ABSTRACT

A device is provided for permitting real time measurement of the activity of dust confined in a ventilation duct. The device includes a radiation emitter for producing a beam for traversing the duct and a light radiation detector placed in front of the beam. The device also includes at least one gamma radiation detector placed facing the ventilation duct. An acquisition unit and a control unit are also provided for acquisition and processing of real time dust activity measurements. Particular utility is found measuring activity of dust leaving a furnace used for melting nuclear installation scrap.

13 Claims, 3 Drawing Sheets

METHOD AND DEVICE FOR THE CONTINUOUS CHECKING OF THE ACTIVITY OF DUST

BACKGROUND OF THE INVENTION

1. Field of the Invention

The invention relates to the control or checking of the activity of dust emitted during the dismantling of nuclear installations and in particular resulting from the melting of miscellaneous scrap.

2. Brief Description of Related Prior Art

During the dismantling of basic nuclear installations, there is frequently a melting of the scrap using a high power (6 megawatt), high capacity, induction or arc furnace. This type of furnace also has a ventilation system permitting special operation in a confined medium. Three filter stages then make it possible to recover all the dust produced during this type of heat treatment.

It is necessary to monitor or at least evaluate the events taking place during melting. It is known to carry out these operations by upstream and downstream balances with respect to the melting phase. At present, only temperature measurements on heat exchange fluids are permanent and carried out during melting. The analyses during melting of particles and dust emitted are carried out by sampling.

It would be very useful to have real time information on the emission kinetics of such dust and, if possible, on the activity situation with respect to said emission. This would make it possible to understand the mechanisms leading to decontamination and consequently permitting action on the performance of the melting in question. Therefore the object of the invention is to obviate this disadvantage by performing such an analysis.

SUMMARY OF THE INVENTION

Therefore a first main object of the invention is to provide a method for checking the activity of the dust emitted during melting of irradiated elements in a furnace comprising continuously measuring the quantity of dust during the passage thereof into a ventilation duct of the furnace and measuring the activity linked with said dust.

The measurement of the dust quantity can take place by measuring the density, preferably using a photovoltaic cell, whilst the activity measurement can take place with a gamma radiation detector coupled to a multichannel analyzer.

A second main object of the invention is to provide a device for checking the activity of the dust emitted during melting of irradiated materials in a furnace and taking place in a ventilation duct comprising a light radiation emitter positioned facing a first wall of the duct, a first light radiation detector placed in front of the wall opposite to the first wall of the duct and supplying a signal characteristic of the density of the traversed medium within the duct, at least one second gamma radiation detector positioned facing the duct and supplying a signal characterizing the activity of the traversed medium within the duct and acquisition and processing means connected to the first and second detectors for receiving said characteristic signals.

Preferably, the emitter is a laser diode.

The first detector is advantageously constituted by a photovoltaic cell.

It is possible to use a multichannel analyzer between the second detector or detectors and the acquisition and processing means.

The latter are preferably constituted by a control acquisition unit directly connected to the detector or detectors and a control unit for processing the signals received and the control of the detectors.

The acquisition and processing unit is preferably constituted for each detector by a voltage measuring means, a memory for recording the voltage values, a means for calculating the mean value of the voltage values and a timer.

The device can be completed by a temperature sensor placed in the duct.

BRIEF DESCRIPTION OF THE DRAWINGS

The invention and its technical features can be better understood as a result of the following description taken with reference to the three attached drawings, wherein.

DETAILED DESCRIPTION OF PREFERRED EMBODIMENT

Figure 1:
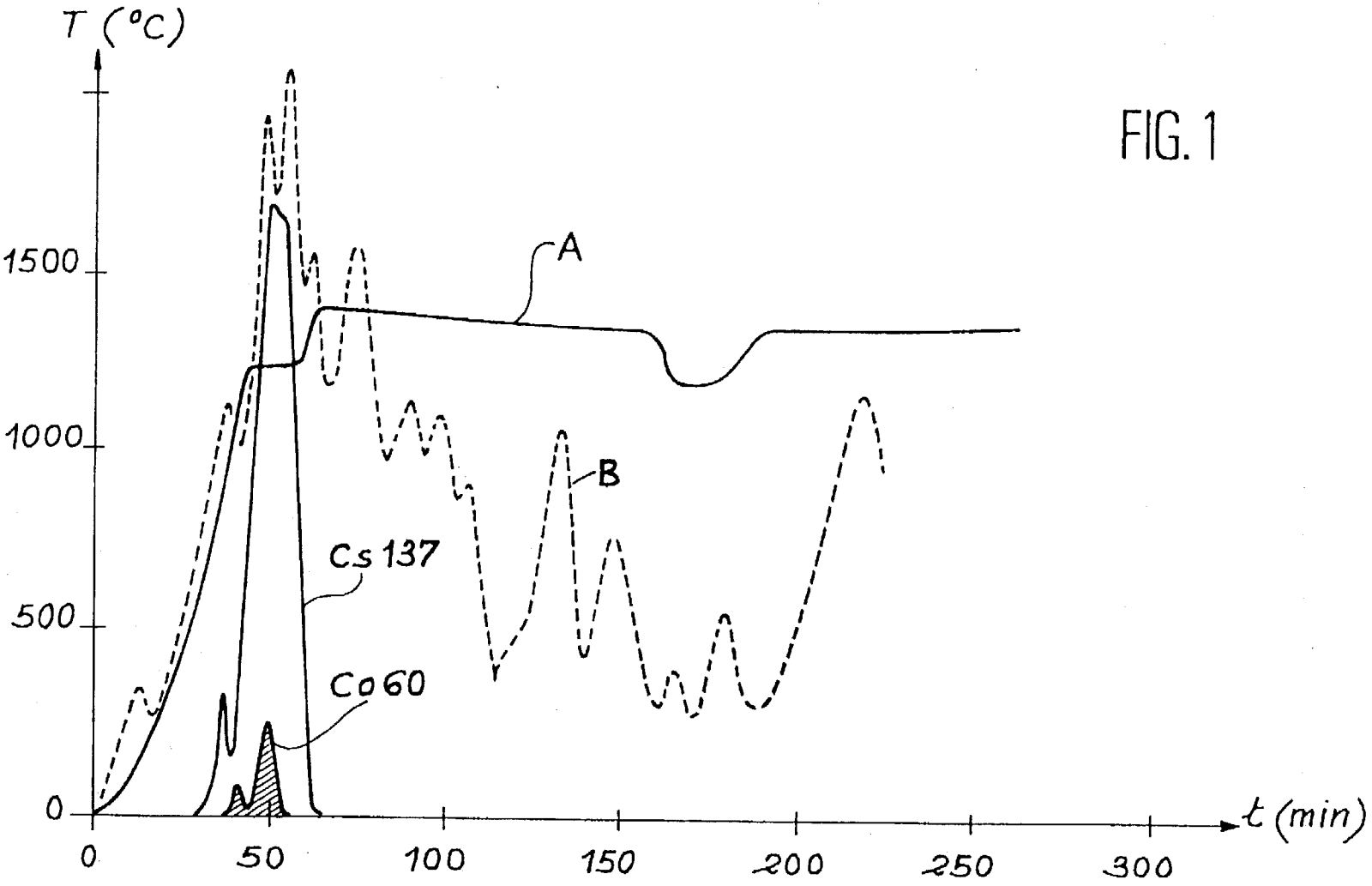
FIG. 1 shows two curves related to the performance of the emission of the activity to be measured during the melting of materials.

With reference to FIG. 1, the method according to the invention is performed on the basis of examination of emission kinetics of the dust at time of melting. The curve A representing the temperature of the dust as a function of time during melting has a level range at around 50 or 60 minutes, then resumes its rise to reach a maximum at a maximum temperature of approximately 1400° C. Correspondingly, the broken line curve B, representing the dust activity, has a clear preponderant peak at the time where the temperature reaches the level range, i.e. at about 60 minutes. It can therefore be deduced therefrom that the activity of the dust is relatively localized in time and that its measurement is consequently facilitated. Thus, if the activity emission was uniformly distributed over the entire melting time, it would be difficult to detect.

This instantaneous and continuous detection of the passage of the activity can consequently make it possible to orient the dust towards the selective filters as a function of the activity thereof, the uncontaminated dust being recycled in order to recover the iron and reduce the volume of waste.

The complete phenomenon can be interpreted as the separation at the time of melting between the oxidized layer containing the contamination as compared with its solid support, i.e. the metal. Thus, the method according to the invention proposes the continuous measurement of the melting so as to be able to measure, at the desired time of the temperature level range, the maximum activity of the dust passing out of the furnace.

The measurements were carried out on standard molten material (scrap contaminated with Co60 and Cs137 and which had previously been treated and oxidizing molten material (scrap contaminated with uranium and treated in the same way) without initial graphite in order to preserve their oxidizing character. The fine line curve represents the passage of the Cs137, whilst the hatched area indicates that of Co60.

The first conclusions on the basis of the experiments performed are relatively surprising. At first glance, it could be assumed that the thermodynamic properties of Cs137 would give it a greater instability and would therefore appear before Co60, but this is not the case. In fact treatment takes place to scrap that has been previously treated and it is assumed that the unstable contamination has ended. Thus, there is only a depth oxidation to the benefit of the occluded pores. The active emission takes place at the instant when melting occurs. It is therefore reasonable to think that the release of the contents of the pores occurs at the instant of the state change.

This hypothesis is aided by the position of the phenomenon. Within the scope of a modelling study of the operation of the furnace, it can be observed that the duration and instant where passage from the solid state to the liquid state occurs coincides with the recording of the activity in the dust.

Figure 2:
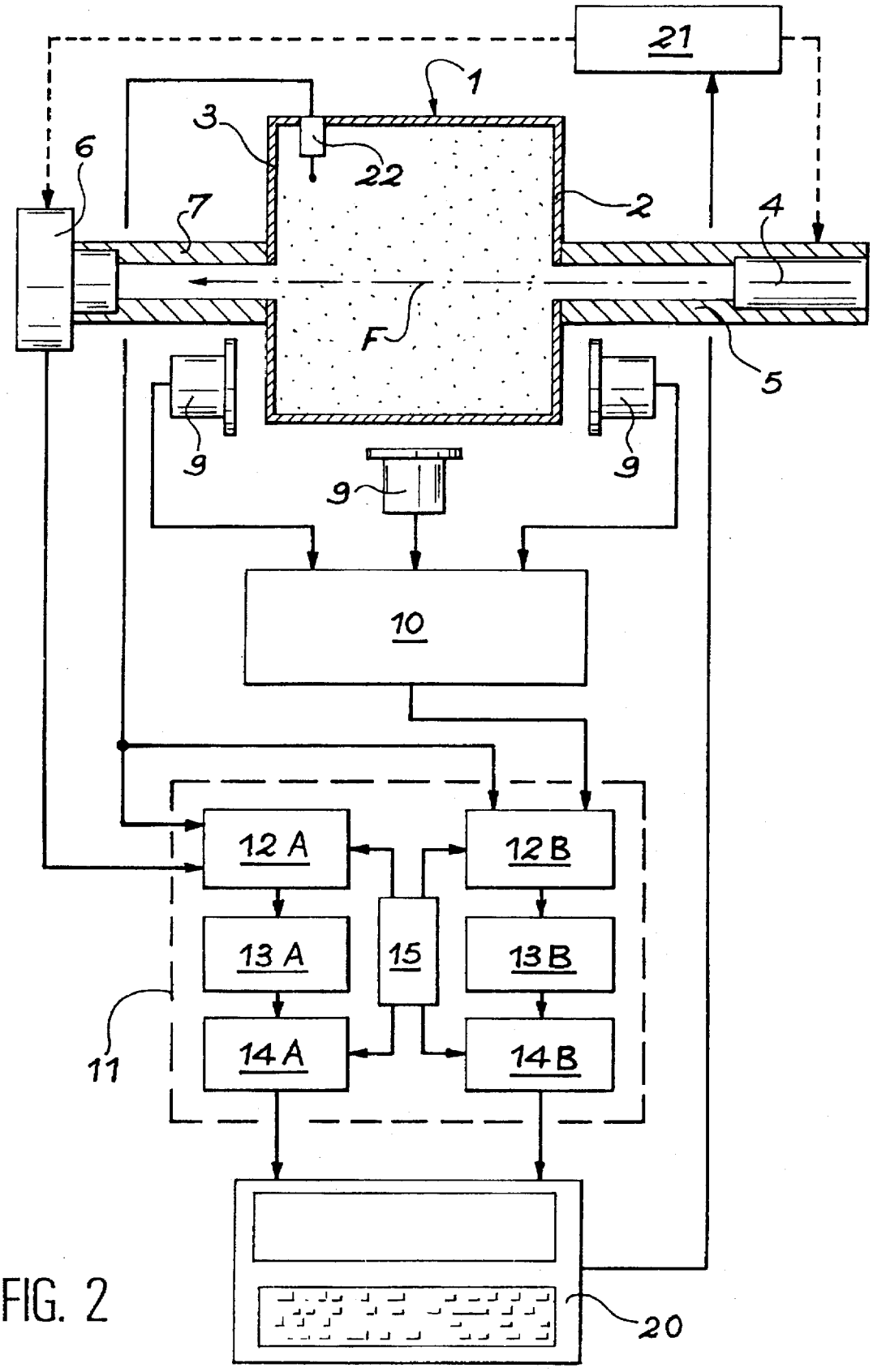
FIG. 2 is a diagram of the device according to the invention.

The implementation referred to here is that used during the operation of the two-unit arc furnace at MARCOULE performed by the applicant. This furnace is intended to melt scrap from basic nuclear installations to be dismantled. This arc furnace has an installed power of 6 GW with a capacity of 14 tons. It has a ventilation system permitting operation in a confined environment. One of its ventilation ducts is shown in cross-section in FIG. 2, where it is designated 1. It has a square cross-section with two opposing, side walls 2 and 3. The dust circulates therein perpendicularly with respect to the plane of FIG. 2.

The measurement of the density of the dust circulating within the duct 1 can take place using several different measuring means such as a light radiation emitter associated with a detector of the corresponding radiation. In the embodiment described, use is made of the light beam F emitted by a laser diode 4 placed facing a first lateral face 2 of the duct 1 outside the latter. This laser diode is positioned with the aid of a tube 5 fixed on the first side wall 2 of the duct 1. The light beam F consequently completely traverses the duct 1 and passes out by a second, opposite lateral face 3. Facing the latter is installed a first light radiation detector in the form of a photovoltaic cell 6 in a position such that it is able to receive and detect the intensity of the radiation of the light beam F after it has traversed the duct 1. A second tube 7 makes it possible to install this type of photovoltaic cell being fixed to the second side wall 3. Thus, when dust circulates in the duct 1 and traverses the beam 1, said dust absorbs part of the latter and modulates the radiation of the beam. The photovoltaic cell 6 consequently detects the resultant radiation flux and delivers the voltage variations resulting from said light variations. This information is supplied to an acquisition and control unit 11.

Thus, information is available concerning the dust level within the duct 1, in the form of a voltage characterizing said dust density in the duct. For example, if it is the intensity of the beam passing through the duct 1 and V is the voltage supplied by the photodiode, the exploitation of the measurement takes place with the aid of the following formula:

$$V=k.\mathrm{Log}(1+a.It/Io)$$

in which Io is the intensity transmitted by the beam in the absence of dust, a and k being coefficients.

Approximating and ignoring overlap phenomenon, it can be accepted that the dust concentration C is defined by the following formula:

$$C=A.(1-V/Vmax)$$

It is thus possible to measure a dust concentration of approximately 30 g/m$^3$ by means of a laser beam of length 1 m and with a cross-section of 6 cm$^2$.

In this case, the detection of the activity of said dust takes place with one or more second gamma radiation detectors 9 placed around the duct 1. Each supplies a characteristic signal of the detected radiation and this signal is supplied to a multichannel analyzer 10. The latter permits a selection of one or more detectors 9 and the thus selected information is supplied to the acquisition unit 11.

The processing and exploitation of said signals are consequently ensured by acquisition and processing means constituted by the acquisition unit 11 and a signal processing and control unit 20, which can be constituted by a real time Powerbook™ microcomputer.

With the aid of such a signal processing and control unit it is possible for an operator to control the starting, regulate the duration of the analysis and synchronize the acquisition conditions of the measurement, all in real time.

The acquisition unit comprises two voltage measuring means 12*a* and 12*b* respectively receiving the signal from the photovoltaic cell and the signals from the multichannel analyzer 10 constituted by gamma radiation detection signals. Use is also made of two memories 13*a* and 13*b* respectively connected to the measuring means 12*a* and 12*b*. Thus, they can record series of measured values concerning the two types of signals.

The acquisition unit advantageously includes mean value calculating means 14*a* and 14*b* connected to the output of the memories 13*a* and 13*b* for supplying characteristic information concerning the phenomenon measured over a predetermined time period. The acquisition unit also includes advantageously a timer 15, which advantageously controls the voltage measuring means 12*a*, 12*b* and the mean value calculating means 14*a*, 14*b*.

The output of said mean value calculating means 14*a*, 14*b* is connected to the input of the processing unit 20, in the present case a Powerbook™ microcomputer.

The assembly includes a power supply 21 for the diode 4, which is controlled by the signal processing and control unit 20, but can also be controlled by the acquisition and control unit 11.

It is also possible to use a temperature sensor 22 placed within the duct 1 in order to possibly correct, at the voltage measuring means 12*a*, 12*b*, the measured values.

Figure 3:
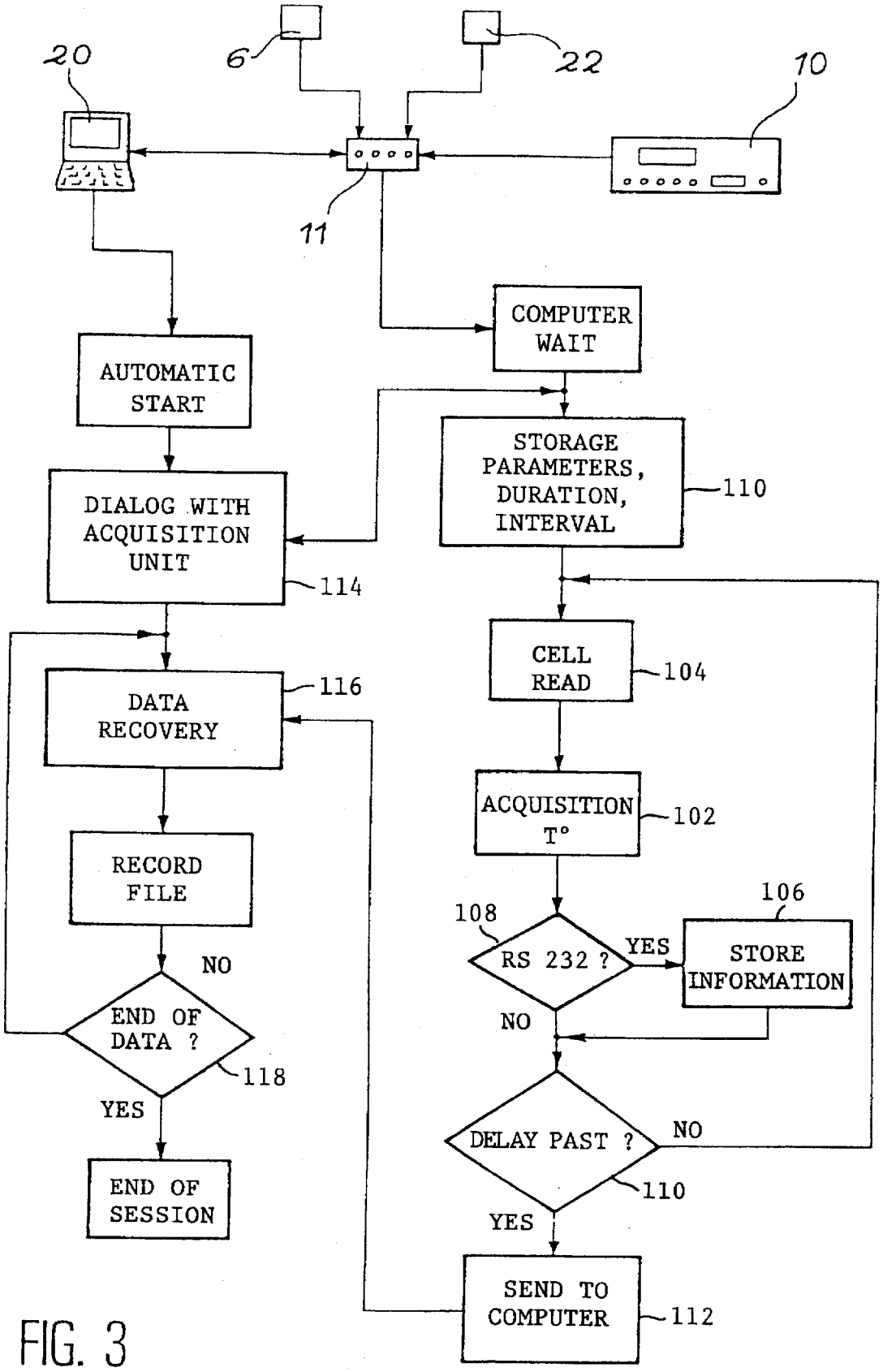
FIG. 3 is a flow diagram of the method according to the invention.

The performance of the operation of such a device can be as follows. It is diagrammatically illustrated by the flow diagram of FIG. 3 and is ensured by the acquisition and control unit 11, as well as by the signal processing and control unit 20.

The acquisition program is stored in the microcomputer constituting the control unit 20. It is thus possible to define a time interval over which calculation takes place of the mean value of the measured voltages, as well as a total duration of the measurement (see block 100).

To the right of the flow diagram can be seen that the data acquisition has taken place, (see block 102) as has the reading of the voltages under the control of the timer (see block 104). As a function of the RS232 information transmission conditions, (see block 108) the information is stored (see block 106).

The timer times the information storage (see block 110). Following a predetermined period value, the information is supplied to the microcomputer (see block 112). On the left-hand side of the flow diagram it can be seen that the microcomputer is in direct dialogue with the acquisition and control unit (see block 114). This microcomputer receives the values accumulated by the acquisition and control unit, the mean value being calculated by predetermined time intervals (see block 116). The cycle continues until the operation is ended (see block 118).

Thus, as a function of the dust type to be measured, it is possible to vary the dust density measurement type. In the preceding example a description was given of the use of a laser in the visible range. The screen formed by the dust was measured. It would also be possible to measure the density of the dust by measuring the optical density, i.e. the density of the volume traversed by the laser beam. It would then merely be necessary to change the wavelength of the radiation and that of the photovoltaic cell. It would therefore be possible to choose an optical measuring system characteristic of a completely gaseous radioactive effluent, i.e. occurring in vapor form.

An infrared laser makes it possible to see in real time the density and radioactivity in the case of the measurement of ruthenium oxide.

With the system according to the invention, it is possible for the operator to act in real time on the operating conditions of the ventilation system as a function of measurements performed in real time on the ventilation duct. The elements used in this system are relatively simple and can easily be controlled by a microcomputer.

I claim:

1. A device for checking the activity and density of dust emitted during melting of irradiated materials in a furnace, comprising a light radiation emitter positioned facing a first side wall of a ventilation duct of said furnace for emitting radiation toward a light radiation detector, said light radiation detector being positioned facing a second side wall of said ventilation duct opposite to the first side wall for generating and supplying a signal characteristic of the density of the dust within the ventilation duct traversed by the radiation emitted by said light radiation emitter, at least one gamma radiation detector placed facing the ventilation duct for generating and supplying a signal characteristic of the activity of the dust within the ventilation duct, and acquisition and processing means connected to the light radiation and gamma radiation detectors and receiving said signals characteristic of the density and activity of the dust, said acquisition and processing means including an acquisition unit and a control unit, said acquisition unit including two voltage measuring means for receiving and measuring voltage values of said signals characteristic of the density and activity of the dust, two memories for recording the measured voltage values, two means for calculating the mean value of the recorded voltage values, and a timer for controlling said two voltage measuring means and said two mean value calculating means, said control unit being for controlling said detectors and for receiving output from said two mean value calculating means.

2. A device according to claim 1, wherein the light radiation emitter comprises a laser diode.

3. A device according to claim 1, wherein the light radiation detector comprises a photovoltaic cell.

4. A device according to claim 1, and further comprising a multi-channel analyzer placed between the at least one gamma radiator detector and the acquisition and processing means.

5. A device according to claim 1, wherein the control unit comprises a microcomputer.

6. A device according to claim 1, further comprising a temperature sensor placed within the duct and connected to said acquisition and processing means.

7. A device for checking the activity and density of dust emitted during melting of irradiated materials in a furnace, comprising a light radiation emitter positioned facing a first side wall of a ventilation duct of said furnace, a light radiation detector positioned facing a second side wall of said ventilation duct opposite to the first side wall, for generating and supplying a signal characteristic of the density of the dust within the ventilation duct, at least one gamma radiation detector placed facing the ventilation duct for generating and supplying a signal characteristic of the activity of the dust within the ventilation duct, a temperature sensor positioned within said duct for generating and supplying a signal characteristic of the temperature within the ventilation duct, and acquisition and processing means connected to the temperature sensor and to the light radiation and the gamma radiation detectors and receiving said signals characteristic of the density, temperature, and activity of the dust.

8. A device according to claim 7, wherein the light radiation emitter comprises a laser diode.

9. A device according to claim 7, wherein the light radiation detector comprises a photovoltaic cell.

10. A device according to claim 7, wherein the acquisition and processing means comprise an acquisition unit connected to the light radiation detector and the at least one gamma radiation detector and a control unit for the processing of the signals and the control of the detectors.

11. A device according to claim 10, and further comprising a multi-channel analyzer placed between the at least one gamma radiation detector and the acquisition and processing means.

12. A device according to claim 10, wherein the control unit comprises a microcomputer.

13. A device according to claim 10, wherein the acquisition unit comprises two voltage measuring means for receiving and measuring voltage values of said signals characteristic of the density and activity of the dust, two memories for recording the measured voltage values, two means for calculating the mean value of the recorded voltage values, and a timer for controlling said two voltage measuring means and said two mean value calculating means.

* * * * *